US009156660B2

(12) United States Patent
Bateman et al.

(10) Patent No.: US 9,156,660 B2
(45) Date of Patent: Oct. 13, 2015

(54) LIFTING BALE

(71) Applicant: MULTIQUIP, INC., Carson, CA (US)

(72) Inventors: Nathaniel Bateman, Boise, ID (US); Dale Olson, Boise, ID (US); Jason Dunn, Boise, ID (US); Tyler Clements, Boise, ID (US); Shane Perkins, Boise, ID (US); Jake Chapple, Boise, ID (US); Cole Baird, Boise, ID (US); Andy Clites, Boise, ID (US)

(73) Assignee: Multiquip, Inc., Carson, CA (US)

( * ) Notice: Subject to any disclaimer, the term of this patent is extended or adjusted under 35 U.S.C. 154(b) by 80 days.

(21) Appl. No.: 14/159,342

(22) Filed: Jan. 20, 2014

(65) Prior Publication Data

US 2015/0203331 A1 Jul. 23, 2015

(51) Int. Cl.

| | |
|---|---|
| ***B28D 1/04*** | (2006.01) |
| ***A45F 5/10*** | (2006.01) |
| ***B66C 1/10*** | (2006.01) |

(52) U.S. Cl.

CPC ..... *B66C 1/10* (2013.01)

(58) Field of Classification Search

USPC ..... 294/165, 167; 125/13.01, 13.03, 14, 17; 299/39.3, 39.6; 30/166.3, 375

See application file for complete search history.

(56) References Cited

U.S. PATENT DOCUMENTS

| | | | | | |
|---|---|---|---|---|---|
| 237,711 | A | * | 2/1881 | Taylor | 294/165 |
| 1,123,453 | A | * | 1/1915 | Witt | 294/165 |
| 2,530,231 | A | * | 11/1950 | Detweiler | 294/161 |
| 2,736,311 | A | * | 2/1956 | Coates | 125/14 |
| 3,966,103 | A | * | 6/1976 | Abrams | 294/144 |
| 4,188,935 | A | * | 2/1980 | Tubesing | 125/13.01 |
| 4,236,356 | A | * | 12/1980 | Ward | 125/13.01 |
| 7,487,770 | B2 | * | 2/2009 | Johnson et al. | 125/13.03 |
| 2007/0163566 | A1 | * | 7/2007 | Johnson et al. | 125/13.01 |
| 2007/0164598 | A1 | * | 7/2007 | Johnson et al. | 299/39.3 |

* cited by examiner

*Primary Examiner* — Paul T Chin

(74) *Attorney, Agent, or Firm* — Frank J. Dykas; Dykas Law Offices, PLLC

(57) ABSTRACT

What is disclosed is a lifting bale that has at least two side supports, at least two cross support, and at least one center support and ideally configured to fit over the motor of a concrete saw, to provide handles for lifting the saw, and to provide an attachment point for a lifting mechanism to attach to the lifting bale and to lift the concrete saw, or other object the lifting bale is attached to, upward from the single point while maintaining the concrete saw or other object in a generally level position.

11 Claims, 4 Drawing Sheets

LIFTING BALE

TECHNICAL FIELD

The presently disclosed and claimed inventive concept(s) generally relates to an apparatus for lifting an object, and more particularly to a lifting bale for attachment to a concrete saw for subsequent lifting.

SUMMARY OF THE DISCLOSURE

What is disclosed is a lifting bale having two side supports in which the side supports are generally arcuate in shape. The side supports have a handle generally at an apex of each of said arcuate shape of said side supports each of the side supports has two attachment mechanisms for attaching said side supports to a device. The side support attachment mechanisms are located generally at first and second distal points to said handle on said arcuate shape of the side supports.

The lifting bale has two cross supports that are generally arcuate in shape and are connected to the side supports at two points that are distal to an apex of said arcuate shape of the cross supports to span a distance between said side supports, The lifting bale has a center support that is generally arcuate in shape an has an attachment mechanism configured for attachment of a lifting device for lifting said lifting bale located generally near an apex of said arcuate shape of the center support. The center support is oriented above and between the side supports and is attached to the cross supports at a first and second point of said center support at a points distal to the attachment mechanism or apex of the center support. In a preferred embodiment, the handles of the side supports are openings in the supports and the opening in the center support is also an opening cut into the center support.

In a preferred embodiment, the lifting bale is configured to bolt to a frame or chasis of a concrete saw. This can be, for example, an opening in the side supports configured for inserting a bolt for attachment to a device.

In a preferred embodiment the lifting bale is made of sheet metal. In this embodiment the handles of the side supports are openings cut into the side supports and the sheet metal from openings is rolled to form handles at the upper aspect of the openings. This allows a user to grasp the handles (one on each side of the concrete saw) and to lift the concrete saw upwards.

In a preferred embodiment, the lifting bale has brace supports between attached supports (between the center support and the cross supports and between the side supports and the cross supports). It is thought that the lifting bale is ideal for a concrete saw, specifically a concrete saw targeted for green concrete, but the lifting bale may have other uses. Specifically, when the lifting bale is attached to a concrete saw, it is attached to the sides of the concrete saw such that the lifting bale spans over the engine of the concrete saw. This allows for the weight of the concrete saw to be evenly distributed on the lifting bale such that only one point of lifting is required to keep the saw upright when lifting.

The purpose of the Summary is to enable the public, and especially the scientists, engineers, and practitioners in the art who are not familiar with patent or legal terms or phraseology, to determine quickly from a cursory inspection, the nature and essence of the technical disclosure of the application. The Summary is neither intended to define the inventive concept (s) of the application, which is measured by the claims, nor is it intended to be limiting as to the scope of the inventive concept(s) in any way.

Still other features and advantages of the presently disclosed and claimed inventive concept(s) will become readily apparent to those skilled in this art from the following detailed description describing preferred embodiments of the inventive concept(s), simply by way of illustration of the best mode contemplated by carrying out the inventive concept(s). As will be realized, the inventive concept(s) is capable of modification in various obvious respects all without departing from the inventive concept(s). Accordingly, the drawings and description of the preferred embodiments are to be regarded as illustrative in nature, and not as restrictive in nature.

DEFINITIONS

Figure 1:
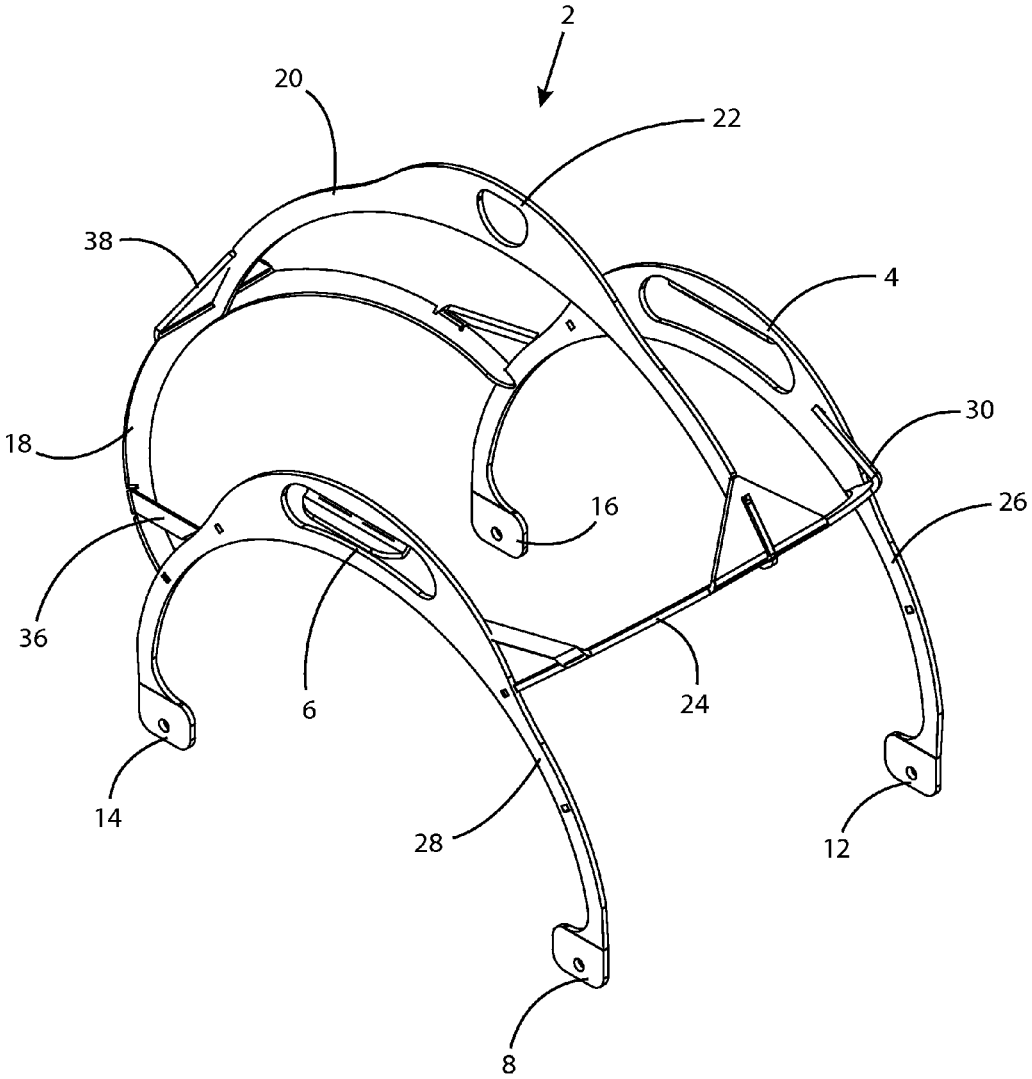
FIG. 1 is a perspective view of a lifting bale.

In the following description and in the figures, like elements are identified with like reference numerals.

The use of "e.g.," "etc," and "or" indicates non-exclusive alternatives without limitation unless otherwise noted.

The use of "including" means "including, but not limited to," unless otherwise noted.

DETAILED DESCRIPTION OF THE DRAWINGS

While the presently disclosed inventive concept(s) is susceptible of various modifications and alternative constructions, certain illustrated embodiments thereof have been shown in the drawings and will be described below in detail. It should be understood, however, that there is no intention to limit the inventive concept(s) to the specific form disclosed, but, on the contrary, the presently disclosed and claimed inventive concept(s) is to cover all modifications, alternative constructions, and equivalents falling within the spirit and scope of the inventive concept(s) as defined in the claims.

FIG. 1 illustrates lifting bale 2 for attachment to an object such as a concrete saw. Lifting bale 2 includes first and second side supports 26, 28 connected by cross supports 18, 24. As illustrated, side supports include lifting handles 4, 6. In a preferred embodiment lifting bale is made of sheet metal with rounded edges. The lifting bale can be provided as an unassembled unit that is assembled into the full lifting bale. In a preferred embodiment lifting handles 4, 6 are rolled edges of openings in the side supports 26, 28. Side supports generally comprise an arcuate shape in which the handles 4, 6 are generally located at or near the apex of the arcuate shape of the side support.

First and second side supports 26, 28 have attachment mechanisms 8, 12, 14, 16 on side supports for attaching side supports to a device, such as a concrete saw. The attachment mechanisms of the depicted embodiment are openings through which an attachment device, such as a bolt, nut, and washer combination can attach the side supports to a corresponding opening in a concrete saw. The attachment mechanisms are generally located on the arms of the arcuate shape of the side supports at locations distal to apex of the arcuate shape of the side supports. This allows for the arcuate shape of the side supports to project generally from a frame support of a concrete saw upwards and over the side of the motor of a concrete saw (see generally FIG. 6).

The side supports 26, 28 of the lifting bale are connected by cross supports 18, 24 which connect to the side supports at points generally between the apex of the arcuate shape of the cross support and the attachment mechanisms of the side supports. Generally this attachment is located approximately at approximately half the distance between the apex of the arcuate shape and the attachment mechanism. the side supports 26, 28 are generally arcuate in shape such that the apex of the arcuate shape is outward from the cross supports.

The lifting bale includes center support 20 which spans between cross supports 18, 24. Center support 20 is joining an arcuate shape and features lifting attachment 22. The center support is connected to the cross supports generally at the apex of the arcuate shape of the cross supports and at points on the center support distal to the apex of the arcuate shape of the center support. The center support in a preferred embodiment includes brace supports 38 in attaching to the cross supports.

The lifting attachment in a preferred embodiment is an opening formed in the center support. In a preferred embodiment the lifting mechanism is positioned such that a hook or similar attachment mechanism from a lifting device such as a crane can be attached at opening 22 and the concrete saw is able to be lifted vertically through the lifting bale and moved with only one attachment point. The lifting bale and lifting point are positioned such that the mass of the saw is distributed evenly amongst the lifting bale such that only one lifting point is needed for lifting the bale and attached saw. Lifting handles 4, 6 are positioned on opposing side supports such that workers can grasp each handle and lift the concrete saw upwards and, for example, into the bed of a vehicle or onto a trailer. In the depicted embodiment, the lifting bale is positioned over the engine portion of a concrete saw and attaches to the chassis of a concrete saw. This additionally provides some protection to the engine of the concrete saw in the event that an object falls onto the saw.

Figure 2:
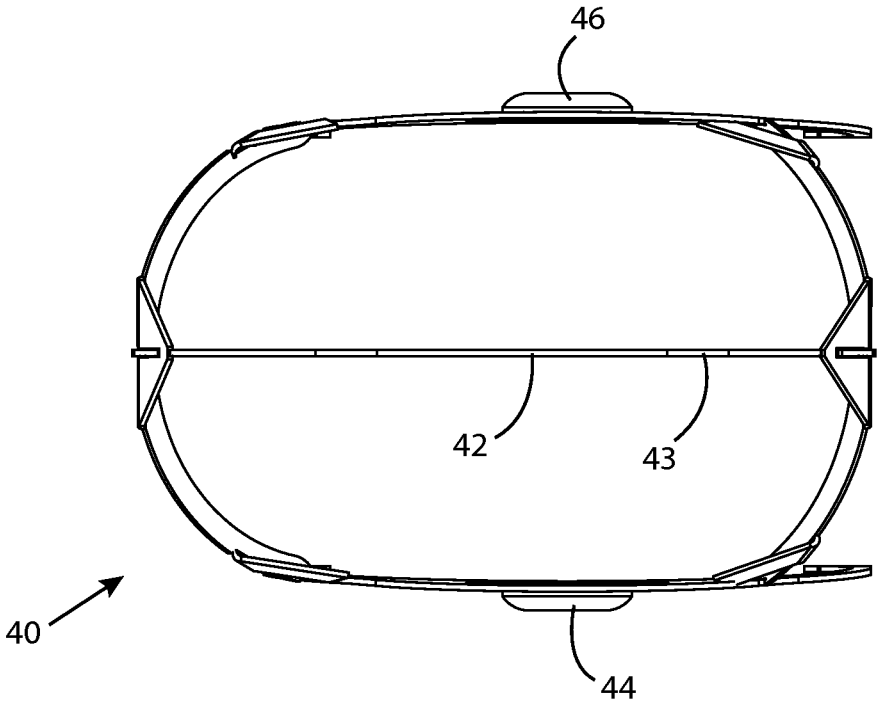
FIG. 2 is a top view of a lifting bale.
Figure 3:
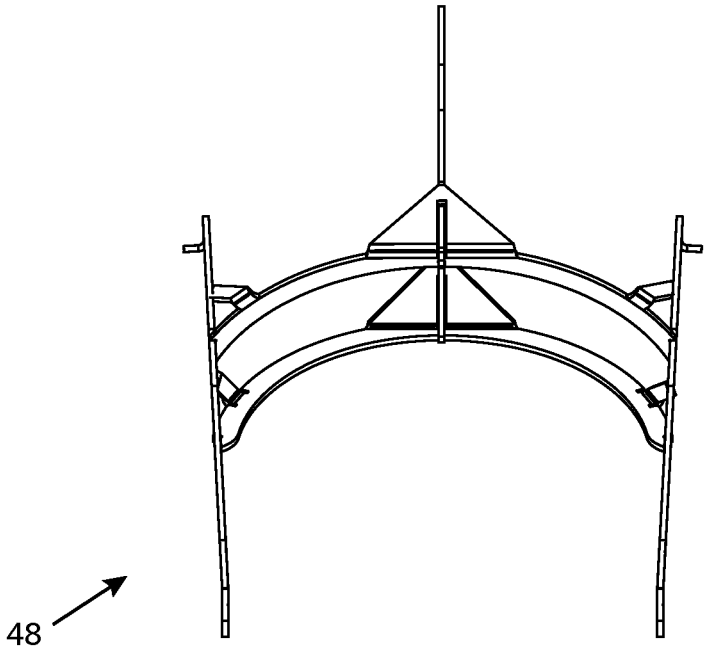
FIG. 3 is a front view of a lifting bale.

FIG. 2 illustrates a top view of the lifting bale. The top view illustrates the user friendly handles 44, 46 of lifting bale 40. Cross support 43 features lifting opening 42 positioned generally such that it is at the center of mass of a concrete saw when the lifting bale is attached to the concrete saw. FIG. 3 illustrates a front view of a preferred embodiment of the invention.

Figure 4:
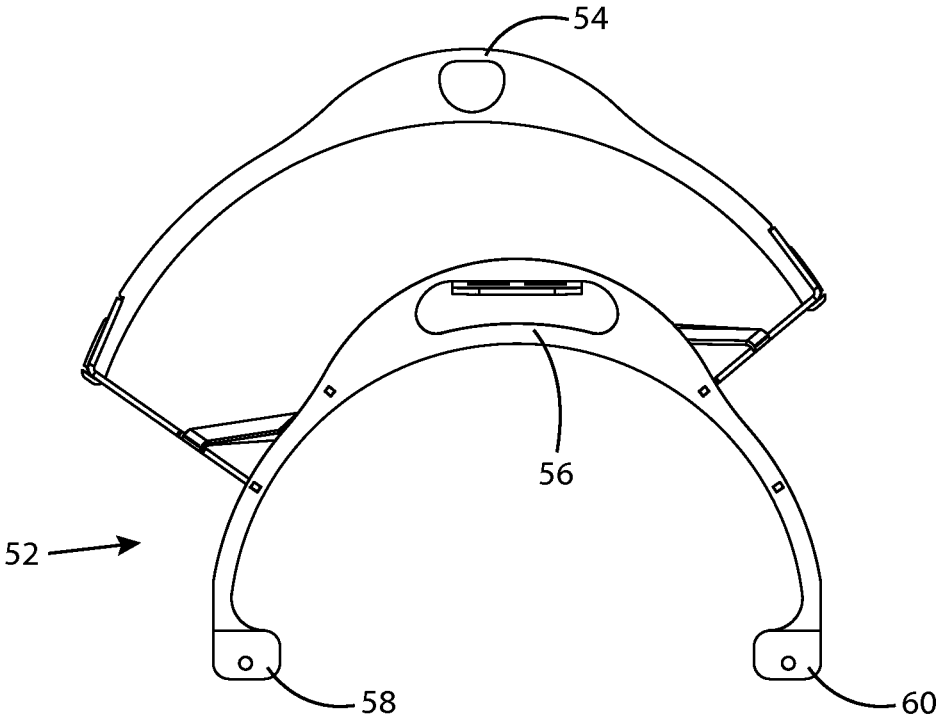
FIG. 4 is a side view of a lifting bale.

FIG. 4 illustrates a side view of a preferred embodiment of the invention. As illustrated, the distal portion 58, 60 of the arcuate shaped side support 57 features lifting handles 56 on each of the side supports. Distally the opening 54 is positioned such that a hook or similar attachment mechanism from the lift can be positioned on the arcuate shaped center on the opening of the arcuate shape center portion. The lifting bale is attached at the distal portions 58, 60 to a device, such as a concrete saw.

Figure 5:
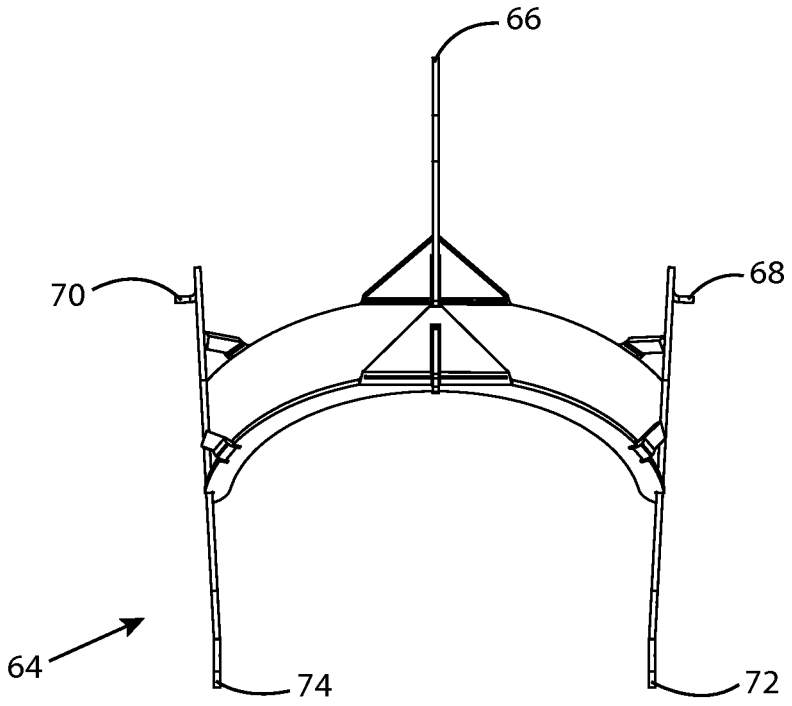
FIG. 5 is a back view of a lifting bale.

FIG. 5 illustrates a rear view of lifting bale 64. The front view illustrates the distal portion 74, 72 of site supports as well as the handles 68, 70 of the side supports. The front view illustrates the special orientation of the side supports 71, 73 oriented in contrast to cross supports 67, 69 and center support 65.

Figure 6:
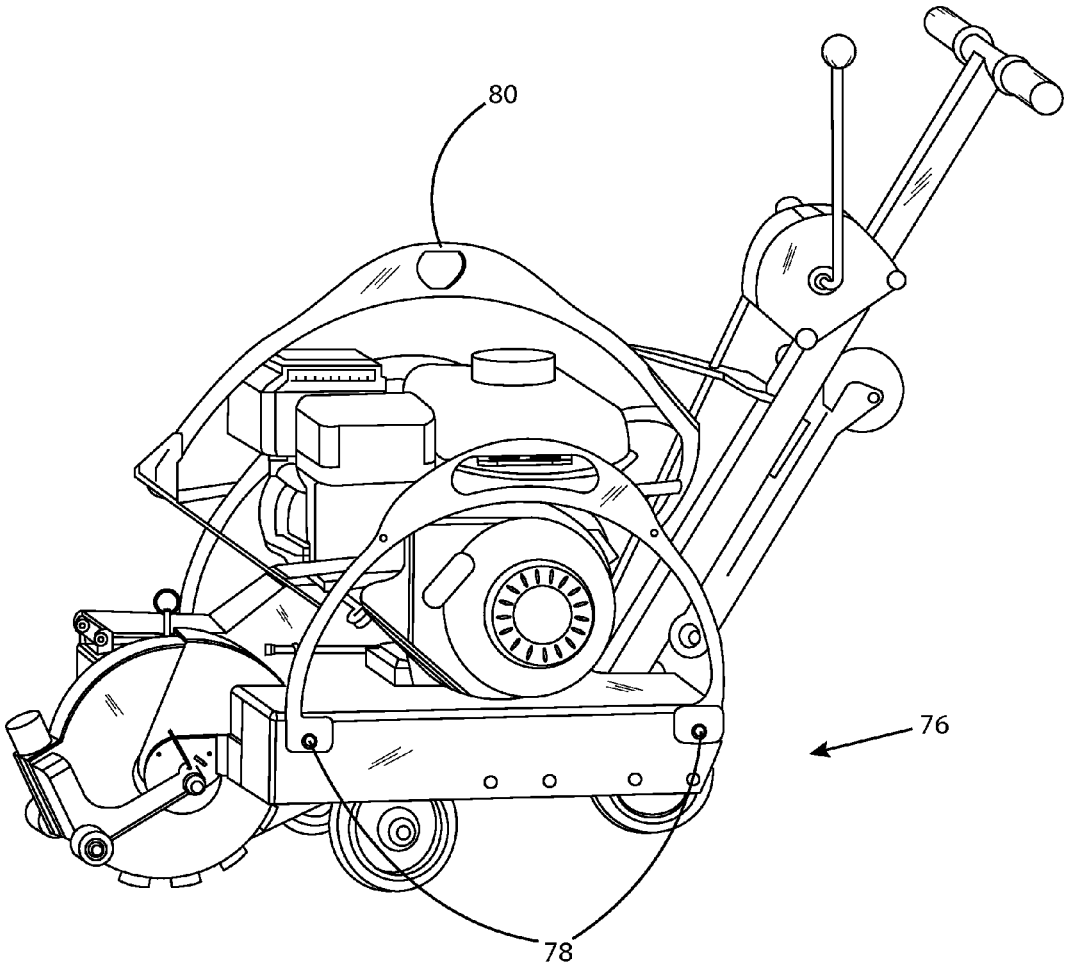
FIG. 6 is a side perspective view of a lifting bale attached to a concrete saw.

FIG. 6 illustrates an embodiment of the lifting bale of the current invention attached to a concrete saw 76. Lifting bale is attached to the concrete saw at attachments 78 on the left side of the concrete saws. Lifting bale is attached to the right side of the concrete saw (not shown). Typical attachments include, but are not limited to, nuts and bolt attachments including washers to the concrete saw, threaded attachments with male portions attaching to female portions of the concrete saw, and While certain exemplary embodiments are shown in the Figures and described in this disclosure, it is to be distinctly understood that the presently disclosed inventive concept(s) is not limited thereto but may be variously embodied to practice within the scope of the following claims. From the foregoing description, it will be apparent that various changes may be made without departing from the spirit and scope of the disclosure as defined by the following claims.

What is claimed is:

1. A lifting bale, said lifting bale comprising:

two side supports, wherein said side supports are generally arcuate in shape, wherein said side supports comprise a handle generally at an apex of each of said arcuate shape of said side supports, wherein each of said side supports comprise two attachment mechanisms for attaching said side supports to a device wherein said attachment mechanisms of said side supports are located generally at first and second distal points to said handle on said arcuate shape;

two cross supports, wherein said cross supports are generally arcuate in shape, wherein said cross supports connect at first and second points distal to an apex of said arcuate shape to span a distance between said side supports, a center support, wherein said center support is generally arcuate in shape, wherein said center support comprises an attachment mechanism configured for attachment of a lifting device for lifting said lifting bale located generally near an apex of said arcuate shape of said center support, wherein said center support is oriented in a plane generally between to said side supports, wherein said center support is attached to said cross supports at a first and second point on said center support at a point distal to said attachment mechanism configured for attachment of a lifting device for lifting said lifting bale and attached to said center supports at a point on each center support generally at an apex of said arcuate shape of said center support.

2. The lifting bale of claim 1, wherein said handles of said side supports comprise openings in said side supports.

3. The lifting bale of claim 1, wherein said attachment mechanism of said center support comprises an opening in said center support.

4. The lifting bale of claim 1, wherein said attachments devices located on said side supports comprise an opening configured for inserting a bolt for attachment to a device.

5. The lifting bale of claim 1, wherein said supports comprise sheet metal.

6. The lifting bale of claim 5 wherein said handles of said side supports comprise opening cut into said side supports and the sheet metal from said openings rolled into handles.

7. The lifting bale of claim 3 wherein said supports comprise sheet metal.

8. The lifting bale of claim 1 wherein said lifting bale comprises brace supports between attached supports.

9. The lifting bale of claim 1 wherein said lifting bale is attached to a concrete saw.

10. The lifting bale of claim 9 wherein said lifting bale is attached to a concrete saw frame, wherein said concrete saw frame has a front and a back, and a left side and a right side, wherein one of said side supports of said lifting bale is attached to said right side of said concrete saw and wherein the second side support of said lifting bale is attached and said left side of said concrete saw frame.

11. A lifting bale attached to a concrete saw, said lifting bale comprising:

two side supports, wherein said side supports are generally arcuate in shape, wherein said side supports comprise a handle generally at an apex of each of said arcuate shape of said side supports, wherein said handles of said side supports comprise openings in said side supports, wherein each of said side supports is attached to a concrete saw at first and second distal points to said apex of said arcuate shape, wherein said arcuate shapes are oriented such that said arcuate shapes are on generally opposite sides of said concrete saw;

two cross supports, wherein said cross supports are generally arcuate in shape, wherein said cross supports connect at first and second points distal to an apex of said arcuate shape to span a distance between said side supports;

a center support, wherein said center support is generally arcuate in shape, wherein said center support comprises an opening configured for attachment of a lifting device for lifting said lifting bale located generally at an apex of said arcuate shape of said center support, wherein said center support is attached to said cross supports at a first and second point on said center support at a point distal to said attachment mechanism configured for attachment of a lifting device for lifting said lifting bale and attached to said center supports at a point on each center support generally at an apex of said arcuate shape of said center support; wherein each of said supports comprises sheet metal, wherein said handles comprise rolled sheet metal configured for a user's hand to be placed in said handles and to lift said handles, wherein said opening configured for attachment of a lifting device is located such that the opening is approximately at the center of mass of the lifting bale and concrete saw such that a single lifting device attachment is used for lifting said lifting bale and concrete saw.

* * * * *